US006824071B1

(12) United States Patent
McMichael

(10) Patent No.: US 6,824,071 B1
(45) Date of Patent: Nov. 30, 2004

(54) GEL-COAT APPLICATION METHOD AND APPARATUS

(75) Inventor: Jonathan R. McMichael, Indianapolis, IN (US)

(73) Assignee: Glas-Craft, Inc., Indianapolis, IN (US)

( * ) Notice: Subject to any disclaimer, the term of this patent is extended or adjusted under 35 U.S.C. 154(b) by 269 days.

(21) Appl. No.: 09/940,057

(22) Filed: Aug. 27, 2001

(51) Int. Cl.[7] ..... A62C 5/02; B05B 7/12

(52) U.S. Cl. ..... 239/8; 239/11; 239/290; 239/296; 239/300; 239/413; 239/422; 239/526

(58) Field of Search ..... 239/8, 11, 290, 239/296–298, 413–415, 422, 525, 526, 300

(56) References Cited

U.S. PATENT DOCUMENTS

| | | | | |
|---|---|---|---|---|
| 3,202,363 A | | 8/1965 | Kautz et al. | |
| 3,521,624 A | | 7/1970 | Wilcox | |
| 3,635,400 A | | 1/1972 | Nord et al. | |
| 3,843,052 A | | 10/1974 | Cowan | |
| 4,386,739 A | | 6/1983 | Kwok | |
| 4,824,017 A | * | 4/1989 | Mansfield | 239/296 |
| 4,928,884 A | | 5/1990 | Smith | |
| 4,967,956 A | | 11/1990 | Mansfield | |
| 5,178,326 A | * | 1/1993 | Kukesh et al. | 239/8 |
| 5,570,839 A | * | 11/1996 | Kukesh | 239/414 |

FOREIGN PATENT DOCUMENTS

| | | |
|---|---|---|
| CH | 234187 | 9/1944 |
| GB | 1104277 | 11/1966 |

* cited by examiner

*Primary Examiner*—Steven J. Ganey
(74) *Attorney, Agent, or Firm*—Brinks Hofer Gilson & Lione

(57) ABSTRACT

A spray-up operator may conveniently control the application of a gel-coat material to a mold or preform to achieve a uniform coating by using an application means comprising a manipulatable nozzle and air control assembly including a liquid nozzle for forming the catalyzed gel-coat material into a fan-like film with substantially flat faces and expanding stream-like edges extending from a liquid orifice, and an air nozzle assembly for directing independently controllable flows of compressed air at the substantially flat faces and at the expanding stream-like edges of the fan-like film.

11 Claims, 5 Drawing Sheets

GEL-COAT APPLICATION METHOD AND APPARATUS

FIELD OF THE INVENTION

This invention relates to plural component spray-up manufacturing methods and apparatus, and more particularly to methods and apparatus for the application of gel-coat to molds and preforms.

BACKGROUND OF THE INVENTION

Plural component spraying systems are used in manufacturing plastic articles by applying resinous materials to a mold or preform for an article. In such systems, a liquid resin and a catalyst for the resin are mixed and directed to a substrate where the catalyst and resin react and harden to form the article. For example, in manufacturing articles with polyester resin, a catalyzing agent for the polyester resin is mixed with the resin; and the resin-catalyst mixture is applied to the substrate. In internal mix systems, the resin and catalyst are mixed within the spraying apparatus, and the mixture is directed by a nozzle onto the substrate. In external mix systems, the resin and catalyst are mixed externally of the apparatus and directed onto the substrate.

Many "plastic" articles, such as boat hulls, shower stalls, bathroom sinks and other shell-like articles of manufacture, are formed from liquid plural component materials, including a liquid polymer resin and a catalyst that converts the liquid polymer resin to a solid state. The manufacture of such articles is frequently performed by the "spray-up" method, that is, by directing a flow of the catalyzed liquid plural component material at a mold or preform for the article to provide an initially liquid coating that subsequently hardens in the form of the article. To provide strength and toughness to the article, reinforcing fibers, preferably glass, are combined with the catalyzed liquid plural component material as one or more layers of the catalyzed liquid plural component material are applied to the mold or preform. Curing and hardening of the catalyzed plural component material with the incorporated reinforcing fibers forms a more durable plastic article.

Because many such articles, for example, boat hulls, must have an attractive outer surface to provide a saleable article, a common method of providing such an attractive outer surface is to provide the mold or preform with a smooth polished surface and to apply, as the first step of the spray-up method in manufacturing the article, a liquid catalyzed plural component "gel coat" material. Gel coat materials are expensive and include catalyzable polymer resins and constituents such as pigments and particulate fillers that can cure on the smooth, polished surface of a mold or preform and provide, as the outer surface of the resulting article, an attractive, smooth, polished and colored, if desired, layer that hides the underlying layered reinforcing structure of the article.

Because the smooth, polished surface of the mold or preform forms the outer surface of the article, it is not necessary that the liquid plural component gel-coat material, or for that matter, the plural component materials used to form the structural layer of the article, be finely atomized, or formed into small particles, for deposition on the mold or preform. In such spray-up operations, and particularly in gel-coat operations, the formation of a uniform coating on the mold or preform is of the most importance, and it is desirable that the liquid gel-coat material be deposited uniformly, regardless of the particulate nature of the gel-coat material being deposited on the mold or preform.

In some spray-up systems, large quantities of pressurized air are used to atomize the liquid components. Such systems are expensive to operate and have a number of operational inadequacies. It is expensive to compress air, and the large quantities of compressed air used by existing systems impose a significant operating cost on the system. In addition, the blast of compressed air used to atomize the liquid components carries a significant quantity of spray particles away from the substrate, wastes the expensive resin and catalyst, creates an unclean spray area and sometimes requires over-spray collection systems, and can contribute to the problem of operating such manufacturing operations safely. Furthermore, the use of large quantities of air during operation of the system can create an undesirable spread of fumes.

In order to overcome some of the inadequacies attending the use of pressurized air to atomize components dispensed from a spraying apparatus, spraying systems have been developed which incorporate airless application techniques.

In prior airless application devices, an airless nozzle has been used to atomize liquid materials which are pumped at high pressure, that is, pressures generally exceeding 300–500 p.s.i. The most commonly used airless nozzle includes an internal, hemispherical passage termination, which is cut through by an external, V-shaped groove to form an elongated, elliptical-like orifice. Liquid material pumped at high pressures through such a spray nozzle is forced by the hemispherical termination of the passageway to converge in its flow at and through the elongated orifice. Because of the converging flow at the orifice, the liquid material is expelled through the orifice into a substantially planar, expanding, fan-like film with stream-like edges, forming particles, which are carried by their momentum to the article target. Such fan-like films, because they are formed by the convergence of the fluid, include heavy streams at their expanding edges, which are referred to as "tails." Because of the heavy stream-like flow in the "tails," the deposited layer of liquid formed by these edge portions of the expanding, fan-like film includes a disproportionate quantity of resin and produces a non-uniform deposit with stripes when the spray pattern is swept across a substrate by a gun operator, as shown in FIG. 10. The non-uniform deposit and resulting stripes make the blending of deposited material into a film of uniform thickness difficult and can lead to a wasteful, excessively thick gel-coat layer.

Compressed air has also been used to solve the problem of tails created by airless spray nozzles. See, for example, U.S. Pat. Nos. 3,202,363; 3,521,824; 3,635,400; 3,843,052; 4,386,739 and 4,967,956.

Nevertheless, a need remains for an inexpensive, conveniently controllable means for uniform gel-coat application to molds and preforms.

SUMMARY OF THE INVENTION

The invention provides an apparatus and method by which a spray-up operator may conveniently control the application of a gel-coat material to a mold or preform to achieve a uniform coating.

Systems of the invention include a first source of gel-coat resin, a second source of catalyst for the gel-coat resin, means for delivering gel-coat resin and catalyst from the first and second sources to an application means, and air delivery means to provide a flow of compressed air to the application means, wherein the application means comprises a mixer for gel-coat resin and catalyst, and a manipulatable nozzle and air control assembly including a liquid nozzle for forming the catalyzed gel-coat material into a fan-like film with substantially flat faces and expanding stream-like edges extending from a liquid orifice, and an air nozzle assembly for directing independently controllable flows of compressed air at the substantially flat faces and at the expanding stream-like edges of the fan-like film.

Apparatus of the invention include an application means manipulated by a workman, such as the apparatus commonly referred to as a "spray gun," comprising, as its forward end, a nozzle and air control assembly including a liquid nozzle forming the liquid coating material into an expanding fan-like film having opposed, generally flat faces between expanding stream-like edges, an air nozzle assembly carrying the liquid dispensing nozzle and including a pair of compressed air nozzles for directing an expanded flow of compressed air at each of the opposed, generally flat faces of the expanding fan-like film of coating material and a pair of air outlets for directing jets of compressed air at the expanding, stream-like edges of the expanding fan-like film of liquid coating material, and an air control element carrying the liquid nozzle and the air nozzle assembly and having a compressed air inlet, means for dividing a flow of compressed air from said compressed air inlet into two independent flows of compressed air leading, respectively, to the pair of compressed air nozzles and to the pair of compressed air outlets, and first and second air valves conveniently located on the air control element for independently controlling the two independent flows of compressed air leading to the pair of compressed air nozzles and to the pair of compressed air outlets.

In preferred methods and apparatus of the invention, a pair of controllable expanding flows of compressed air are directed at the opposed substantially flat faces of the expanding liquid film of mixed gel-coat material from the opposite sides thereof to impinge upon the expanding catalyzed liquid gel-coat film closely adjacent the liquid nozzle, and a pair of controllable compressed air jets are directed forwardly and generally parallel to each other at the expanding stream-like edges of the catalyzed liquid gel-coat film on axes impinging the expanding stream-like edges of the liquid gel-coat film generally at or forwardly of the area of impingement of the expanding flows of compressed air on the faces of the liquid film, and the pair of controllable expanding compressed air flows and the pair of controllable compressed air jets are independently adjusted to obtain a uniform deposition of gel-coat on a mold or preform surface. Preferred apparatus may include liquid mixing means for the gel-coat resin and catalyst in the liquid passageway of the air control element.

Incorporation of air control valve means, permitting adjustment the compressed air flows impinging on the faces and edges of the expanding film of mixed gel-coat material, on the gel-coat application means permits the workman to adjust the conditions of operation to achieve an improved and more uniform application of gel-coat to the article-forming substrate, reducing the cost associated with an unwanted non-uniform thickness of the expensive gel-coat material and providing an attractive outer surface finish to the resulting articles.

BRIEF DESCRIPTION OF THE DRAWINGS

FIG. 5 being a front view of the air nozzle assembly; FIG. 6 being a cross-sectional view of the air nozzle assembly of FIG. 5 at a plane through the central axis of the nozzle assembly at line 6—6 of FIG. 5; FIG. 7 being a cross-sectional view of the air nozzle assembly of FIG. 5 at a plane through the central axis of the nozzle assembly at line 7—7 of FIG. 5; and FIG. 8 is a rear view of the air nozzle assembly of FIGS. 5-7.

DETAILED DESCRIPTION OF A PREFERRED EMBODIMENT OF THE INVENTION

Figure 1:
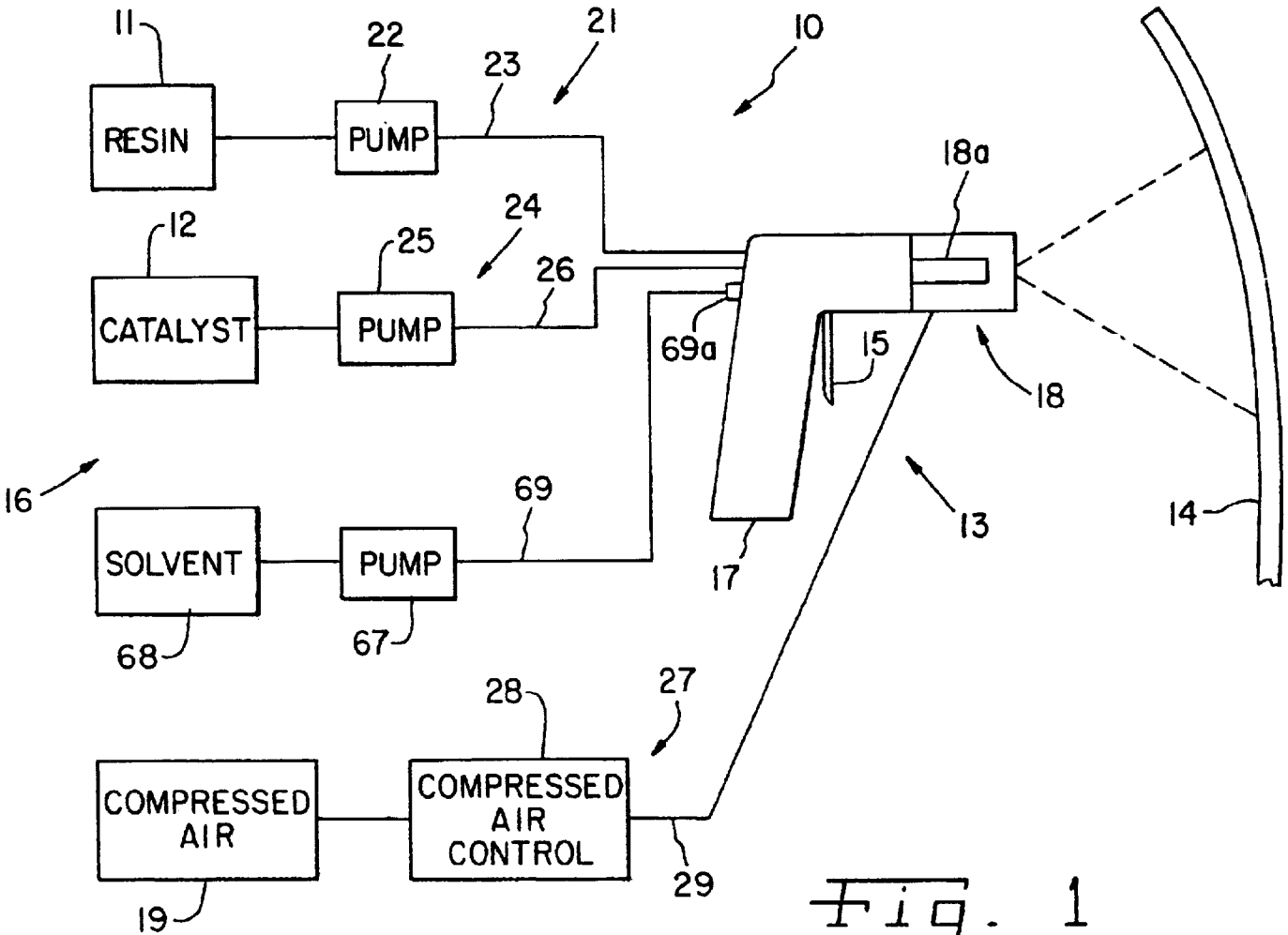
FIG. 1 is a block diagram of an internal mix system to illustrate the invention.

FIG. 1 schematically illustrates an internal mix, gel-coat application system that may incorporate the invention. The system is generally designated by reference numeral 10 and includes a first source 11 of a first component, e.g., a gel-coat resinous material; a second source 12 of a second component, e.g., a catalyst for the resinous gel-coat material; an application means 13 for mixing the catalyst and gel-coat resin and for directing the mixture at a mold or preform 14; and delivery means 16 for delivering the gel-coat resin, catalyst, and compressed air to the application means 13 during operation of the system. Any of a number of liquid gel-coat materials can be used in the invention.

Various aspects of application means 13 are shown in FIGS. 2-9. The application means 13 preferably comprises a hand-held gun, which is manipulatable by a workman in applying gel-coat to a mold or preform 14. Such an application means 13 includes a gun body 17 with an air control and nozzle assembly 18 of the invention at its front. The gun body 17, on which the air control and nozzle assembly 18 is carried, can be any of several gun bodies known in the art, e.g., the Model INDY II™ of Glas-Craft, Inc. of Indianapolis, Ind. Air control and nozzle assembly 18 preferably incorporates a mixer 18*a* to mix the gel-coat resin and catalyst. A preferred mixer is sold by TAH Industries, Inc., of Imlaystown, N.J. 03526 as their Part No. 121–126. Air control and nozzle assembly 18 comprises a combined compressed air and airless liquid nozzle assembly, illustrated in FIGS. 2-9, in which compressed air and liquid pressure are combined in uniformly applying mixed gel-coat resin and catalyst to the substrate 14 of the mold or preform. Thus, system 10 includes a compressed air source 19.

Delivery means 16 includes means 21 for delivering the gel-coat resin including a resin pump 22 and gel-coat resin conduit 23 between the source of gel-coat resin 11 and the gun body 17; means 24 for delivering catalyst for the gel-coat resin including a catalyst pump 25 and a catalyst conduit 26 between the source of catalyst 12 and the gun body 17; and means 27 for delivering compressed air including a compressed air control 28 and an air conduit 29 between compressed air source 19 and the application means 13. If desired, a source of solvent 68 may be connected through a solvent pump 67, and a flexible solvent hose 69 to a solvent flow control valve 69*a* carried by the gun body 17 to provide a cleansing flow of solvent through the liquid passageways of the gun body.

As described below, a flow of gel-coat resin from resin source 11 and a flow of catalyst from catalyst source 12 are delivered to gun body 17 where they are controlled by valves in the gun body actuated by a trigger 15 and directed to air control and nozzle assembly 18 which mixes the gel-coat resin and catalyst, and directs the catalyzed gel-coat material to mold or preform 14. Air control and nozzle assembly 18 includes a conventional airless nozzle 160 (see FIG. 2 and 9) to which the mixed gel-coat resin and catalyst are directed and which forms the catalyzed gel-coat mixture into a fan-like film with substantially flat faces between expanding stream-like edges (see FIG. 9). Air control and nozzle assembly 18 is also connected to the source of compressed air 19 and provides a plurality of compressed air flows to co-act with the airless nozzle 160 to assist in formation of a uniform deposited film of the resin-catalyst mixture, particularly by reducing the non-uniformity caused by the stream-like edges of the fan-like resin-catalyst film formed by the airless nozzle 160. Thus, mixed gel-coat resin and catalyst can be uniformly applied to mold or preform 14, where it solidifies to form a smooth and lustrous outer surface of an article of manufacture. Mold 14 can be for an article, such as a boat hull, boat part, shower stall, or the like.

Figure 2:
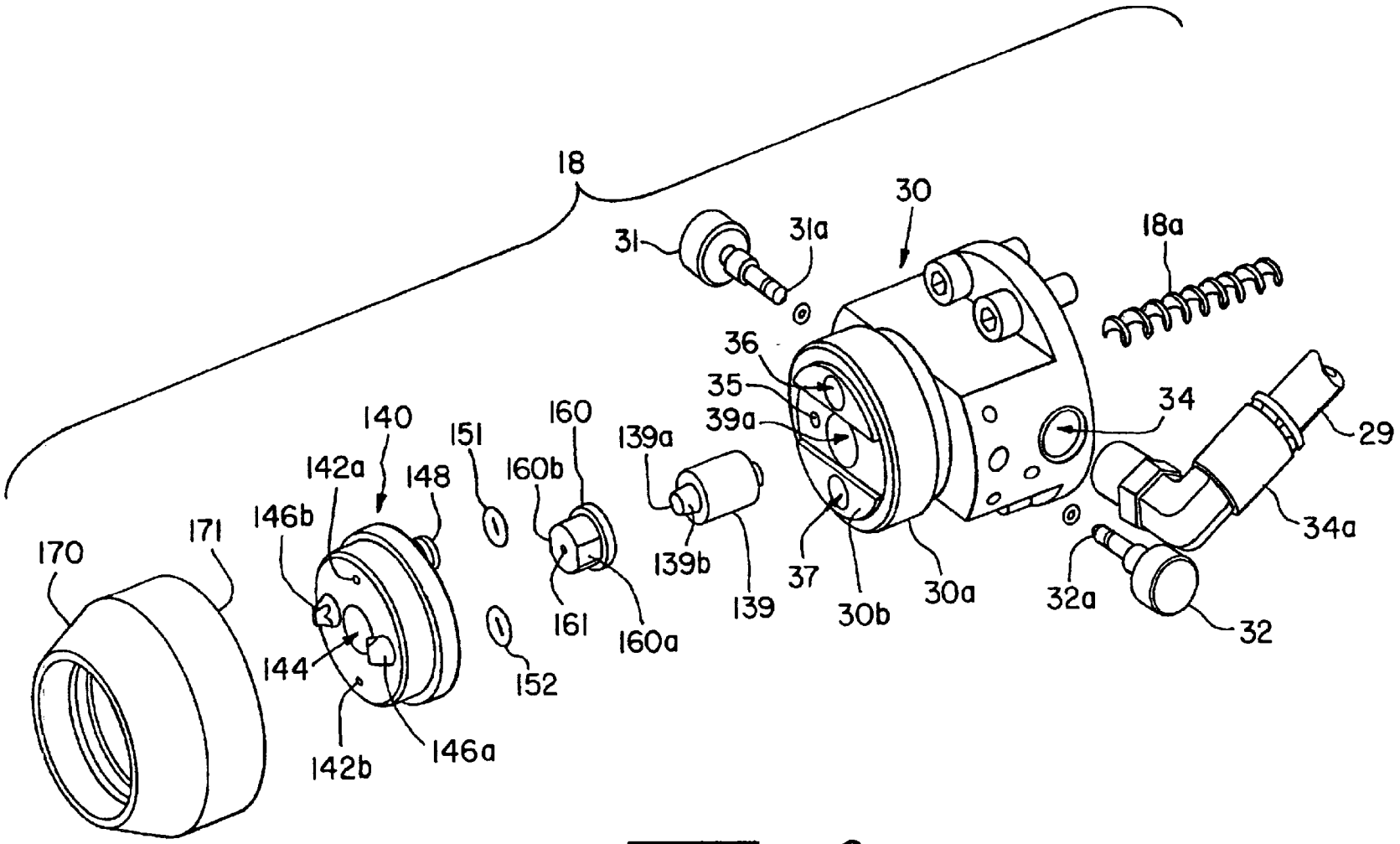
FIG. 2 is an exploded view of a preferred air control and nozzle assembly of the invention.

In one embodiment of this invention, compressed air from source 19 is directed through a factory pressure regulator 28 and a flexible air hose 29 to a compressed air inlet 34 formed in air control and nozzle assembly 18 into which a hose fitting 34*a* is threaded, as illustrated by FIG. 2. In other embodiments, the flexible air conduit 29 may be attached to the gun body 17, which may also carry an air valve that is actuated by the gun's trigger (with the actuation of resin and catalyst valves carried by the gun body) and upon actuation delivers a flow of compressed air to the air control and nozzle assembly 18 through internal passageways formed in the gun body and air control element 30.

Figure 4:
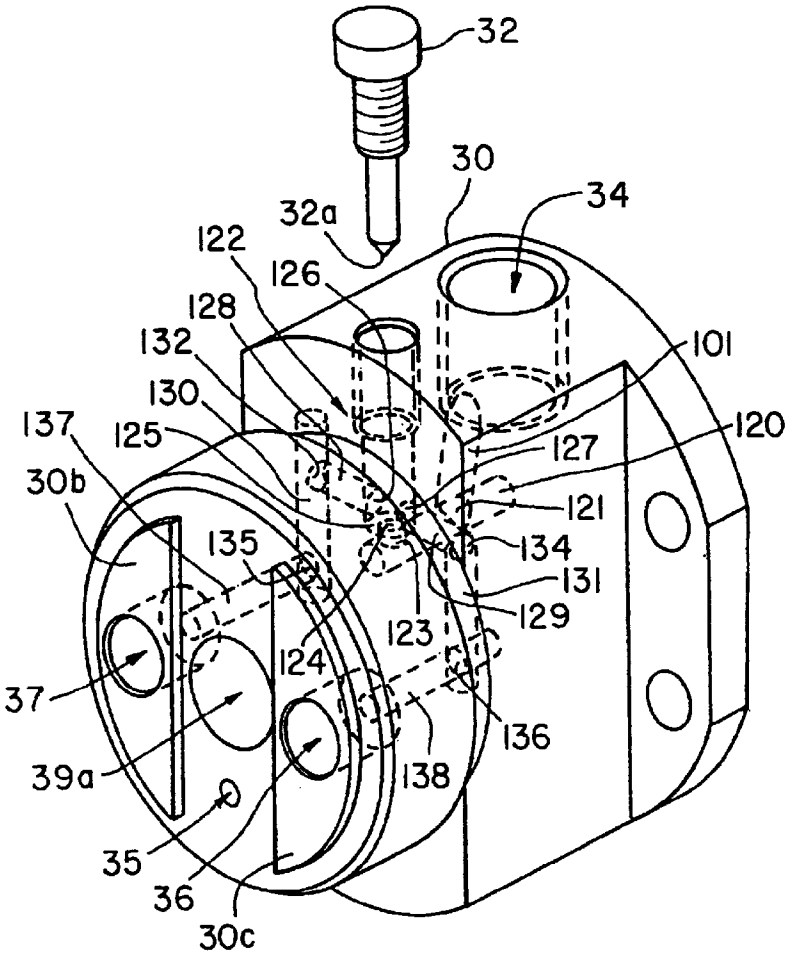
FIG. 4 is another perspective view of the air control element of the invention illustrated in FIGS. 2 and 3, showing a second set of air passageways in phantom line, and, exploded therefrom, a valve element for controlling the flow of air in the illustrated set of air passageways.
Figure 3:
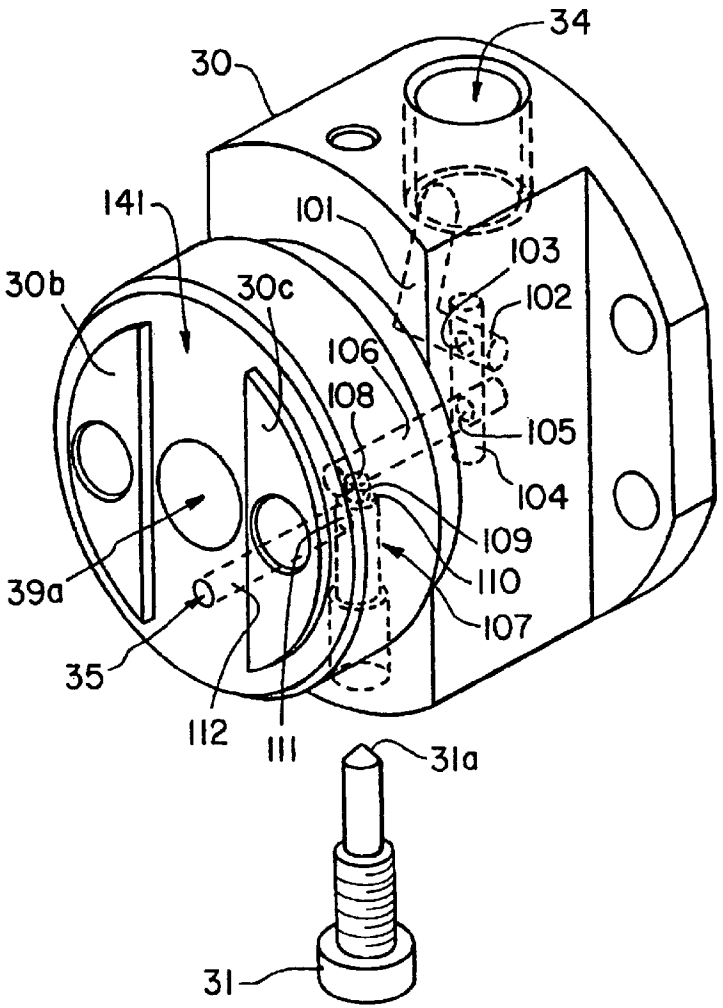
FIG. 3 is a perspective view of the air control element of the invention illustrated in FIG. 2 showing one set of air passageways in phantom line, and, exploded therefrom, a valve element for controlling the flow of air in the illustrated set of air passageways.

The air control and nozzle assembly 18 of the invention is shown in greater detail in the exploded view of FIG. 2, and the perspective and cross sectional views of the air control element 30, FIGS. 3 and 4, and of the air nozzle assembly 140, FIGS. 5-8.

As shown in FIG. 2, the air control and nozzle assembly 18 includes an air control element 30, which carries a pair of air control valve elements 31 and 32, and a connector 34*a* for a flexible hose which forms compressed air passageway 29. Air control element 30 includes a labyrinth of internal air passageways by which compressed air entering the compressed air inlet opening 34 is divided into two independent flow paths, one of which includes valve element 31 and leads from valve 31 to a first opening 35, and the other of which includes the second valve element 32 and leads to a second set of openings 36 and 37. The air passageways of the air control element 30 may be formed, for example, by drilling blind holes and closing the surface ends of the holes with set screw seals. The air control element 30 carries a controllable flow of catalyzed gel-coat resin material through a central passageway leading from a gun body passageway to an opening 39a located midway between openings 36 and 37.

FIGS. 3 and 4 are perspective drawings to illustrate the labyrinth of passages that divides the compressed air entering air inlet 34 into two independently controllable flows of compressed air. To avoid the confusing clutter that would be created by showing all of the internal passageways formed within air control element 30, FIG. 3, with phantom lines, illustrates only the passageways by which the compressed air is led from the air inlet 34 past the valve control element 31 to opening 35, and FIG. 4 illustrates, with phantom lines, only the passageways by which the compressed air is led from the air inlet 34 past the valve control element 32 to openings 36 and 37, it being understood that the passageways shown in FIGS. 3 and 4 are all formed within air control element 30.

Figure 9:
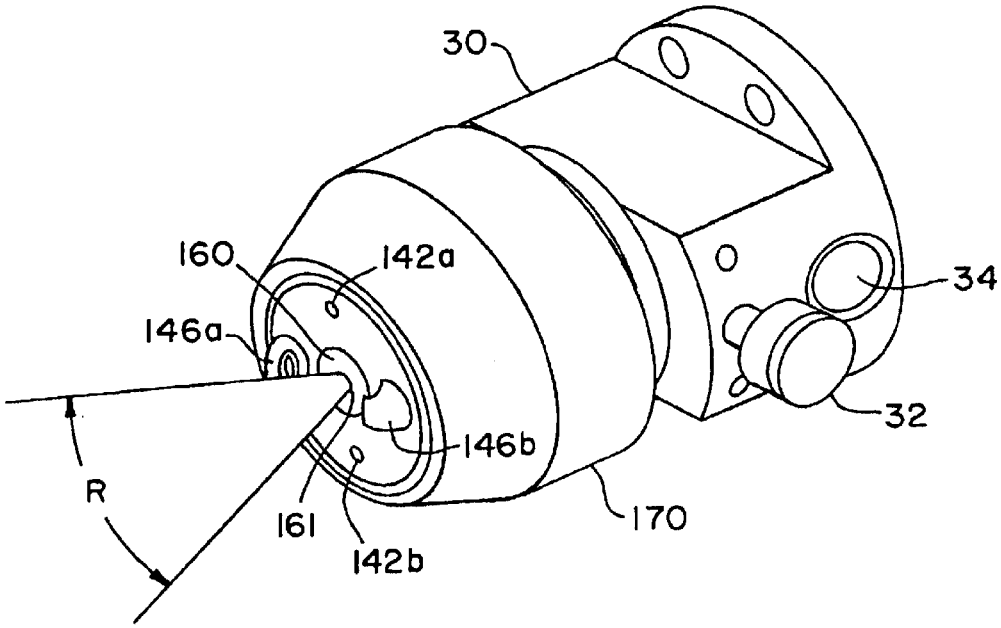
FIG. 9 is a perspective view of the air control and nozzle assembly of the invention in operation to illustrate the expanding fan-like film of catalyzed gel-coat material formed by the airless liquid nozzle and its relationship to the air outlets of the air nozzle assembly whereby compressed air jets are directed at the expanding stream-like edges of the expanding fan-like film and expanded flows of compressed air are directed at the opposed, substantially flat faces of the expanding fan-like film.

Referring now to FIG. 3, which illustrates the internal air passageways between the air inlet 34 and the air outlet 35. As indicated in FIG. 2, compressed air from the flexible hose compressed air passageway 29 enters air inlet 34 through a threaded hose connection 34*a* that is threaded into air inlet opening 34, and flows from the hose connection 34*a* through a passageway 101 to an intersecting passageway 102, which lies transversely of passageway 101. From passageway 102 the compressed air flows through an intersection opening 103 and through downwardly extending passageway 104 to an opening 105 at the intersection of the downwardly extending passageway 104 and a forwardly extending passageway 106. The forward end of passageway 106 intersects the upper end of the bore 107 at intersection opening 108. The bore 107 carries valve control element 31 and forms an air control opening 109 and a surrounding valve seat 110. The flow of air through air control opening 109 is controlled by the extent to which valve seat end 31*a* of control element 31, which is threadedly carried by air control element 30 in bore 107, is displaced from valve seat 110. Compressed air which controllably passes between the valve seat end 31*a* of valve control element 31 and the valve seat 110 formed by air control element 30 escapes through air opening 111 formed in bore 107, travels through passageway 112 and escapes through opening 35. As will be explained further below, this flow of compressed air will travel outwardly between the extended forward-most faces 30*b* and 30*c* of the air control element 30 for ejection from air nozzle outlets 146*a* and 146*b* (FIGS. 5 and 6) and directed at the substantially flat faces of the fan-like film of gel-coat, as illustrated by FIG. 9.

FIG. 4 illustrates, in phantom lines, the second set of air passageways formed within air control element 30. As indicated above, compressed air is directed into the air inlet 34 by a threaded hose fitting 34*a* in the air inlet 34, and compressed air travels from the hose fitting 34*a* through passageway 101, which intersects a forwardly extending passageway 120 at an intersection opening 121. (Forwardly extending passageway 120 lies below the passageway 102 illustrated in FIG. 3.) The compressed air entering the forwardly extending passageway 120 through intersection opening 121 travels to the forward end of passageway 120 which intersects, at intersection opening 123, the control valve bore 122, which carries the valve control element 32.

The control valve bore 122 forms at its lower end an air control opening 124 and a surrounding valve seat 125. The flow of compressed air through the air control opening 124 and past the valve seat 125 is controlled by the extent to which the seat-engaging end 32*a* of the valve control member 32, which is threadedly carried by the air control element 30 in bore 122, is displaced from the valve seat 125. Compressed air, which controllably flows between the valve seat 125 and the seat-engaging end 32*a* of valve control element 32, flows outwardly from control valve bore 122 through a pair of openings 126 and 127, formed by the intersections of transverse passageways 128 and 129, and outwardly through passageways 128 and 129, to their intersections with a pair of downwardly extending passageways, 130 and 131, respectively, which intersect passageways 128 and 129 at intersection openings 132 and 134, respectively. Compressed air then flows downwardly through passageways 130 and 131 to intersection openings 135 and 136, respectively, and forwardly through intersecting passageways 137 and 138, and outwardly from air outlets 37 and 36, respectively. As will be described in greater detail below, the controlled flow of air from outlets 36 and 37 of the air control element 30 will be directed by air outlets 142*a* and 142*b* (FIGS. 5 and 7) of the air nozzle assembly 140 at the expanding stream-like edges of the expanding fan-like film, as illustrated in FIG. 9.

Thus, an application operator, by adjustment of the position of valve control members 31 and 32 at the forward end of the application means 13 can adjust the velocity of the air jets directed from openings 142*a* and 142*b* of the air nozzle assembly 140 at the expanding stream-like edges of the expanding fan-like film of gel-coat formed by liquid nozzle 160 (FIG. 2), and can control the expanding fan-like flows of compressed air formed by the air nozzles 146*a* and 146*b* and directed at the substantially flat faces of the expanding fan-like film of gel-coat material. (See FIG. 9).

As indicated above, the passageways 101 to 112 of FIG. 3 and 120 to 138 of FIG. 4, including their intersection openings, may be formed by drilling holes in the air control element 30 and closing and sealing the ends at the surface of the air control element 30, for example, by threading set screws into the holes formed in the air control element 30.

Referring again to FIG. 2, opening 39*a* is formed by a cylindrical cavity in the air control element 30, which accepts a plastic liquid seal member 139. The rear portion and periphery of the liquid seal member 139 provides a seal, with the walls of cylindrical cavity 39*a*, against the pressure exerted on the catalyzed gel-coat mixture by pumps 22 and 25, and the forward portion of the liquid seal member 139 is formed to sealingly engage the rear of airless liquid nozzle 160. Air nozzle assembly 140 (FIGS. 5-8) has a central opening 144 to accept the forward end of the liquid nozzle 160 and position its orifice so the expanding fan-like film of catalyzed gel-coat material is properly oriented with respect to air outlets 142*a*, 142*b*, 146*a*, and 146*b*, as shown in FIG. 9. When the air control and nozzle assembly 18 is assembled, the seal member 139 is placed in the cavity 39*a* forming the liquid outlet opening of the air control element 30, the liquid nozzle 160 is placed over the forward end of the liquid seal member 139 with its flat sides substantially vertical, the air nozzle assembly 140 is placed over the liquid nozzle 160 with its seal extension members 148 and 149 extending into air outlets 36 or 37, and the threaded nut 170 is threaded onto threaded forward end 30*a* of the air control element 30 to fasten and seal the parts into a functioning unit. FIG. 2 shows how the air control and nozzle assembly 18 is assembled.

Retainer nut 170 includes a threaded portion 171 at its rear which threads onto a threaded portion 30*a* at the forward end of the air control element 30. At its forward portion, retainer nut 170 forms an inwardly projecting flange 171*a* (not shown) which engages front flange 143 of air nozzle assembly 140, urging it rearwardly and toward the forward-most faces 30*b*, 30*c* of threaded forward end of the air control element 30. Air nozzle assembly 140 is formed with a central opening 144 which is shaped to include two, flat surfaces 144*a* and 144*b* (see FIGS. 5 and 8) which engage the flat outer side surfaces 160*a* and 160*b* of the airless liquid nozzle 160 and orient it with respect to air outlets 142*a*, 142*b*, 146*a* and 146*b*. A rearwardly facing flange 145 is formed around central opening 144 as shown in FIGS. 6 and 7; and as the retaining nut 170 is threaded on the forward end 30*a* of the air control element 30 and its rearwardly facing flange 171*a* (not shown) engages flange 143 of air nozzle 140 and urges air nozzle 140 rearwardly, flange 145 of air nozzle 140 presses liquid nozzle 160 and sealing means 139 rearwardly into sealing engagement with air control element 30 in cylindrical cavity 39*a*. As shown in FIG. 2, sealing means 139 is preferably formed with a forward portion 139*b* of reduced diameter to fit within a cavity at the rear of liquid nozzle 160. Sealing means 139 can thus be sealingly engaged between liquid nozzle 160 and the air control element 30.

When the trigger 15 of the gun body 17 is pulled rearwardly, opening the gun valve assemblies controlling the flow of gel-coat resin and catalyst, the gel-coat resin and catalyst flow under the influence of pressure imparted by pumps 22 and 25 through one or more internal passageways in the gun body into the central passageway of air control element 30 that carries static mixer 18*a* and delivers a catalyzed gel-coat mixture through a central passageway 139*a* formed in sealing means 139, and liquid nozzle 160 and its opening 161. Liquid nozzle 160 is a conventional airless atomizing nozzle, frequently referred to as an "airless spray tip" and includes an interior passageway formed to force the resin to flow into a fan-like film with expanding stream-like edges extending forwardly from liquid orifice 161, as shown in FIG. 9. Such liquid nozzles may be purchased to form fan-like films with included angles from 20° to over 60°, angles of 30° to 50° being preferred.

FIGS. 5-8 illustrate the air nozzle assembly 140 which directs four controllable flows of compressed air at the expanding fan-like film of catalyzed gel-coat material to control the uniformity of the gel-coat layer applied to the mold or preform.

When the retainer nut 170 is tightened against air control element 30, the plastic seal member 139, which is squeezed between the rear surface of opening cavity 39*a* and the rear of liquid nozzle 160, can prevent the rear surface of air nozzle assembly 140 from engaging the front surfaces 30*b* and 30*c* of the air control element 30. In any event, the flow of compressed air from air outlet 35 of air control element 30 is directed to passageways 146*c* and 146*d* (FIGS. 6 and 8), and outwardly through compressed air nozzles 146*a* and 146*b*, which expand the flows of compressed air into expanding fan-like flows directed at the substantially flat faces of the liquid resin expelled from liquid nozzle 160, as indicated by FIG. 9. The engagement of the threads of threaded element 170 with the threaded forward portion 30*a* of air element 30 provides a sufficient air seal to ensure that substantially all of the compressed air leaving air outlet 35 is expelled from air nozzles 146*a* and 146*b*.

As best illustrated by FIG. 7, the air nozzle assembly 140 includes a pair of seal extension members 148 and 149 that are press-fit into the rear of the air nozzle assembly 140 and form, with the air nozzle assembly 140, passageways 142*c* and 142*d*, leading to air outlets 142*a* and 142*b* in the forward face of the air nozzle assembly. The seal extension members 148 and 149 carry o-rings 151 and 152. As indicated by FIG. 2, when the air nozzle assembly 140 is assembled to air control element 30, the seal extension members 148 and 149 extend into cavities formed at the forward end of air outlets 36 and 37 of air control element 30, and o-rings 151 and 152 sealingly engage the air control element 30 so that air directed to the compressed air outlets 36 and 37 of the air control element 30 is expelled through passageways 142*c* and 142*d* and outlets 142*a* and 142*b*, respectively, as jets of compressed air formed, respectively, by air outlet 142*a* and passageway 142*c* and by air outlet 142*b* and passageway 142*d*. As indicated by FIG. 9, the compressed air jets leaving compressed air apertures 142*a* and 142*b* are directed at the expanding stream-like edges of the expanding fan-like film of gel-coat resin expelled from the liquid nozzle 160.

Figure 5:
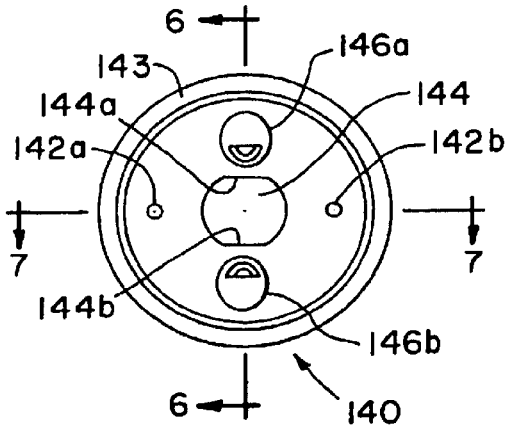
FIGS. 5-8 are illustrations of a preferred air nozzle assembly of the air control and nozzle assembly of the invention.
Figure 6:
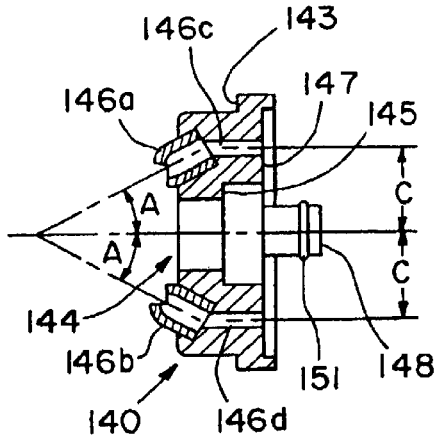
Figure 7:
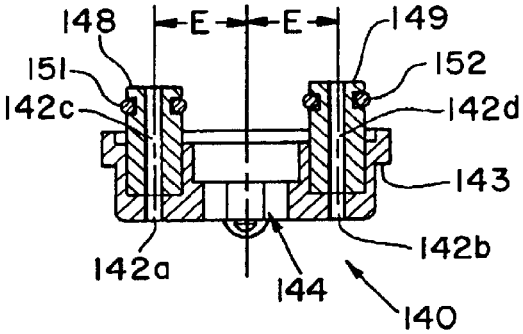
Figure 8:
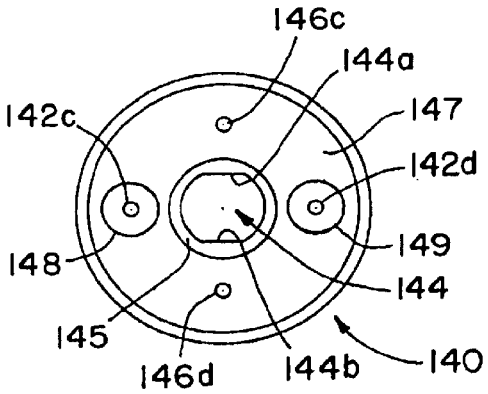

As shown by FIGS. 5-9, the air nozzle assembly 140 surrounds the airless nozzle 160, which preferably forms an expanding fan-like film with an included angle R. The compressed air nozzles 146*a* and 146*b* of the nozzle assembly 140 are located on a plane that is perpendicular to and bisects the expanding fan-like film formed by the airless nozzles and are oriented to directed their expanding flows of compressed air at acute, included angles A with respect to the substantially flat faces of the expanding fan-like liquid film for impingement upon the substantially flat faces of the expanding fan-like film at distances from about one-half an inch to about one inch or more forwardly of the orifice 161 of airless nozzle 160. Preferably, as indicated in FIGS. 5 and 6, the air nozzles 146*a* and 146*b* are equally spaced from the center line of the liquid orifice 160 by distance C of about ⅜" to about ½", and most preferably about ⅜", and directed to form equal acute, included angles A of about 25° to about 30° with respect to the substantially flat faces of the expanding fan-like liquid film.

As further illustrated by FIGS. 5-9, the compressed air jets leaving the orifices formed by the passageways 142*a*, 142*c*, and 142*b*, 142*d*, respectively, are generally parallel to both the longitudinal axis of the nozzle assembly 140 and to each other, and are equally spaced from the central axis of the liquid nozzle 160 a distance E of about 3/10" to about 4/10", and most preferably about ⅜". Preferably the air orifices 142*a* and 142*b* lie in a plane that perpendicularly bisects the plane through the center of the air nozzles 146*a* and 146*b*. In a particularly preferred embodiment of the air nozzle assembly, where the liquid nozzle 160 forms an expanding fan-like film with an included angle R of about 40° to about 50°, the distance C is about ⅜"; the angle A is about 30° and the distance E is about ⅜".

For preferable operation, the distance E (the separation between the center line of the air passageways 142*a*, 142*b* from the center line of the liquid orifice 161) divided by the tangent of one-half of the angle R (the included angle formed by the expanding fan-like film) is greater than the distance C (the separation between the center line of the air nozzles 146*a* and 146*b* and the center line of the liquid orifice 161) divided by the tangent of A (the acute angle between a line parallel to the central axis of liquid nozzle 160 and the center axes of air nozzles 146*a* and 146*b*).

Figure 10:
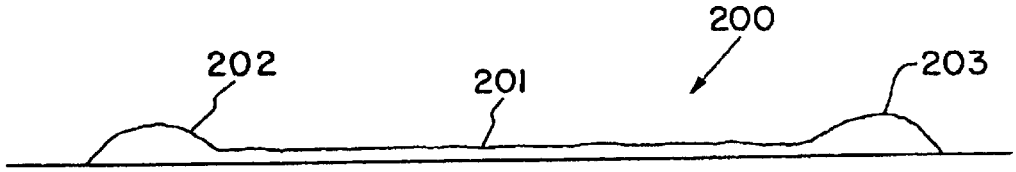
FIG. 10 illustrates the non-uniform deposition of gel-coat on a mold or preform without the benefit of the invention because of the non-uniform stream-like flow of liquid at the edges of the expanding fan-like film from an airless liquid nozzle.

In the absence of the controllable flows of compressed air of this invention, the expanding liquid film formed by the liquid orifice 160 includes a relatively thin central portion with substantially flat opposed faces, having a high ratio of width to thickness, and two expanding stream-like edges that are characterized by a heavy stream-like flows of liquid having almost circular cross sections. FIG. 10 illustrates an example of a cross section of a layer of gel-coat resin that will be deposited by liquid nozzle 160 in the absence of the flow of compressed air from air nozzle assembly 140. As indicated by FIG. 10, the deposited layer 200 includes a relatively thin, substantially uniform central portion 201 and two thick outer portions 202 and 203, formed by the stream-like edges of the liquid film.

Figure 11:
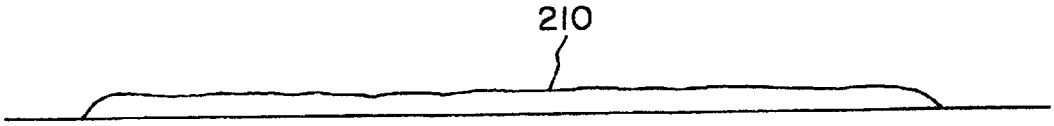
FIG. 11 illustrates the substantially uniform deposition of gel-coat that can be obtained on a mold or preform with the invention.

By adjustment of the air control valves 31 and 32, and the resulting controlled impingement of compressed air from the air outlets 142*a* and 142*b*, 146*a* and 146*b* of the air nozzle assembly 140, the non-uniformities in the deposited film caused by the operation of the liquid nozzle 160 can be corrected to provide a substantially uniform deposited film of gel-coat 210, as illustrated by FIG. 11.

Those skilled in the art will recognize that the method and apparatus of the present invention has many applications and that the present invention is not limited to the preferred embodiment illustrated and described herein, and is incorporated into all embodiments covered by the scope of the following claims, including those equivalents which are not obvious in view of the prior art.

What is claimed is:

1. A plural component gel-coat application system, comprising:

a hand manipulatable application means for directing gel-coat at a substrate;

first means for providing a flow of a first gel-coat component to said hand manipulatable application means;

second means for providing a flow of a second gel-coat component to said hand manipulatable application means;

a source of compressed air; and air delivery means for providing a flow of compressed air to said hand manipulatable application means, said hand manipulatable application means including mixing means for mixing said first and second gel-coat components to provide mixed first and second gel-coat components for application, an airless liquid nozzle for forming the mixed first and second gel-coat components into a fan-like film with substantially flat faces and stream-like edges extending from a liquid orifice, and an air nozzle assembly for directing first expanded flows of compressed air at the substantially flat faces of the fan-like film and for directing second flows of compressed air at the stream-like edges of the fan-like film, said hand manipulatable application means further including first valve means for adjusting said first expanded flows of compressed air and second valve means for adjusting said second flows of compressed air.

2. A plural component gel-coat application system, comprising:

a hand manipulatable application means for directing gel-coat at a substrate;

first means for providing a flow of a first gel-coat component to said hand manipulatable application means;

second means for providing a flow of a second gel-coat component to said hand manipulatable application means;

a source of compressed air; and air delivery means for providing a flow of compressed air to said hand manipulatable application means, said hand manipulatable application means including mixing means for mixing said first and second gel-coat components to provide mixed first and second gel-coat components for application, an airless liquid nozzle for forming the mixed first and second gel-coat components into a fan-like film with substantially flat faces and stream-like edges extending from a liquid orifice, and an air nozzle assembly including a pair of air nozzles for forming and directing first expanded flows of compressed air at the substantially flat faces of the fan-like film of mixed gel-coat components as expanding fan-like flows, and further including a pair of air passages with openings for directing second flows of compressed air at the stream-like edges of the fan-like film as jet-like flows, said hand manipulatable application means further including first valve means for adjusting said first expanded flows of compressed air and second valve means for adjusting said second flows of compressed air.

3. A plural component gel-coat application system, comprising:

a hand manipulatable application means for directing gel-coat at a substrate;

first means for providing a flow of a first gel-coat component to said hand manipulatable application means;

second means for providing a flow of a second gel-coat component to said hand manipulatable application means;

a source of compressed air; and air delivery means for providing a flow of compressed air to said hand manipulatable application means, said hand manipulatable application means including:

mixing means for mixing said first and second gel-coat components to provide mixed first and second gel-coat components for application;

an airless liquid nozzle for forming the mixed first and second gel-coat components into a fan-like film with substantially flat faces and stream-like edges extending from a liquid orifice;

an air nozzle assembly comprising:

a nozzle body having a central opening at its longitudinal centerline in which the airless liquid nozzle is positioned;

a pair of air nozzles equally spaced on opposing sides of the longitudinal center line of the nozzle body for directing first expanded flows of compressed air at the substantially flat faces of the fan-like film; and a pair of air orifices, equally spaced on opposing sides of the longitudinal center line of the nozzle body and located on a line that perpendicularly bisects the line between the pair of air nozzles, for directing second flows of compressed air at the expanding edges of the fan-like resin film, said hand manipulatable application means further comprising a compressed air control element, including passageways for dividing the flow of compressed air from said air delivery means into two independent flows of compressed air and first and second valve means, said first valve means controlling one of said independent flows of compressed air and said second valve means controlling the other of said independent flows of compressed air, said airless liquid nozzle and air nozzle assembly being carried by said compressed air control element.

4. A method of forming a gel-coat on an article mold, comprising:

delivering a flow of a gel-coat resin to an application means;

delivering a flow of a catalyst for said gel-coat resin to said application means;

delivering a flow of compressed air to said application means;

mixing said gel-coat resin and said catalyst for said gel-coat resin and forming the mixture into a fan-like film with substantially flat faces between expanding edges extending from the application means;

dividing the flow of compressed air into a first compressed air flow and a second compressed air flow;

dividing the first compressed air flow into two airflows, forming the two air flows to provide two expanding air flows and directing said two expanding airflows at the substantially flat faces of the fan-like film of said mixture from opposite sides of the film within about an inch of the application means;

dividing the second flow of compressed air into two generally parallel air jets directed at the expanding edges of the fan-like film, and adjusting the first compressed air flow and second compressed air flow to provide, from the fan-like film, a substantially uniform application of gel-coat to the article mold.

5. A means for application of a liquid coating material, comprising a liquid dispensing nozzle forming the liquid coating material into an expanding, fan-like film having opposed, generally flat faces between expanding stream-like edges, a compressed air nozzle assembly carrying the liquid dispensing nozzle, including a pair of compressed air nozzles for directing an expanded flow of compressed air at each of the opposed, generally flat faces of the expanding fan-like film of coating material, and a pair of air outlets for directing jets of compressed air at the expanding, stream-like edges of the expanding fan-like film of liquid coating material, and an air control element carrying said liquid dispensing nozzle and air nozzle assembly having a compressed air inlet and passages for dividing a flow of compressed air into two independent compressed air flows, one set of passages leading to the pair of compressed air nozzles, and a second set of passages leading to the pair of compressed air outlets, and further carrying first and second air valves for independently controlling the flows of compressed air from the pair of compressed air nozzles and from the pair of compressed air outlets.

6. A gel-coat application device, comprising:

a liquid nozzle forming a gel coat material into an expanding fan-like liquid film having opposed substantially flat faces between expanding stream-like edges;

a compressed air nozzle assembly, including an opening in which the liquid nozzle is carried, two compressed air nozzles located on each side of the liquid nozzle, each compressed air nozzle forming and directing an expanding flow of compressed air at one of the opposed, substantially flat faces of the expanding fan-like flow of gel-coat material, and two compressed air outlets located between the compressed air nozzles and directing compressed air at the expanding stream-like edges; and an air control element on which the airless liquid nozzle and compressed air nozzle assembly are carried, said air control element including a compressed air inlet, a first set of passageways and a first adjustable air valve between said air inlet and said two compressed air nozzles, and a second set of passageways and second adjustable valve between said compressed air inlet and said two compressed air outlets.

7. A plural component application system, comprising:

a first source of a first liquid component;

a second source of a second liquid component;

a hand-held application means for directing mixed first and second components at a substrate;

liquid delivery means for providing a flow of said first component from said first source to said hand-held application means and for providing a flow of said second component from said second source to said hand-held application means;

mixing means for mixing said first and second liquid components to provide a mixture of said first and second liquid components for application, a source of compressed air; and air delivery means for providing a flow of compressed air from said compressed air source to said hand-held application means; and said hand-held application means including an airless liquid nozzle for forming the mixed first and second components into a fan-like film with substantially flat faces and stream-like edges extending from a liquid orifice, and an air nozzle assembly for directing first expanded flows of compressed air to impinge on the substantially flat faces of the fan-like film and for further directing second flows of compressed air to impinge on the stream-like edges of the fan-like film, said hand-held application means further including first valve means for adjusting said first expanded flows of compressed air and second valve means for adjusting said second flows of compressed air.

8. The system of claim 7 wherein said first and second components comprise a gel-coat material.

9. The system of claim 7 wherein said hand-held application means includes said mixing means upstream of said airless liquid nozzle.

10. A plural component application system, comprising:

a first source of a first liquid component;

a second source of a second liquid component;

a hand-held application means for directing mixed first and second components at a substrate;

liquid delivery means for providing a flow of said first component from said first source to said hand-held application means and for providing a flow of said second component from said second source to said hand-held application means;

mixing means for mixing said first and second liquid components to provide a mixture of said first and second liquid components for application, a source of compressed air; and air delivery means for providing a flow of compressed air from said compressed air source to said hand-held application means, said hand-held application means including an airless liquid nozzle for forming the mixed first and second components into a fan-like film with substantially flat faces and stream-like edges extending from a liquid orifice, and an air nozzle assembly comprising:

a nozzle body having a central opening at its longitudinal centerline in which the airless liquid nozzle is positioned;

a pair of air nozzles equally spaced on opposing sides of the longitudinal center line of the nozzle body for directing the first expanded flows of compressed air at the substantially flat faces of the fan-like film; and a pair of air orifices, equally spaced on opposing sides of the longitudinal center line of the nozzle body and located on a line that perpendicularly bisects the line between the pair of air nozzles, for directing said second flows of compressed air at the expanding edges of the fan-like resin film, said hand-held application means further comprising a compressed air control element, said air control element including said first and second air valve means for said first and second compressed air flows, said first valve means adjusting said first expanded flows of compressed air and said second valve means adjusting said second flows of compressed air.

11. A plural component application system, comprising:

a first source of a first liquid component;

a second source of a second liquid component;

a hand-held application means for directing mixed first and second components at a substrate;

liquid delivery means for providing a flow of said first component from said first source to said hand-held application means and for providing a flow of said second component from said second source to said hand-held application means;

mixing means for mixing said first and second liquid components to provide a mixture of said first and second liquid components for application, a source of compressed air; and air delivery means for providing a flow of compressed air from said compressed air source to said hand-held application means, said hand-held application means including an airless liquid nozzle for forming the mixed first and second components into a fan-like film with substantially flat faces and stream-like edges extending from a liquid orifice, an air nozzle assembly for directing first expanded flows of compressed air to impinge on the substantially flat faces of the fan-like film and for further directing second flows of compressed air to impinge on the stream-like edges of the fan-like film, and an air control element having a compressed air inlet and a plurality of internal passageways dividing a flow of compressed air entering the compressed air inlet into two independently controllable flows of compressed air, one of said two independently controllable flows of compressed air being controlled by first valve means and the other of said two independently controllable flows of compressed air being controlled by second valve means, said first valve means adjusting said first expanded flows of compressed air and said second valve means adjusting said second flows of compressed air, said air control element carrying said airless liquid nozzle in communication with said mixing means and carrying said air nozzle assembly in communication with each of said independently controllable floats of compressed air.

* * * * *

UNITED STATES PATENT AND TRADEMARK OFFICE

CERTIFICATE OF CORRECTION

PATENT NO. : 6,824,071 B1
DATED : November 30, 2004
INVENTOR(S) : Jonathan R. McMichael It is certified that error appears in the above-identified patent and that said Letters Patent is hereby corrected as shown below:

Column 14,
Line 64, change “floats” to -- flows --

Signed and Sealed this

Eighth Day of March, 2005

JON W. DUDAS
*Director of the United States Patent and Trademark Office*